US012129660B2

(12) United States Patent
De Rick

(10) Patent No.: US 12,129,660 B2
(45) Date of Patent: Oct. 29, 2024

(54) PANEL COMPRISING COUPLING PARTS

(71) Applicant: FLOORING INDUSTRIES LIMITED, SARL, Bertrange (LU)

(72) Inventor: Jan De Rick, Geraardsbergen (BE)

(73) Assignee: UNILIN BV, Wielsbeke (BE)

( * ) Notice: Subject to any disclaimer, the term of this patent is extended or adjusted under 35 U.S.C. 154(b) by 239 days.

(21) Appl. No.: 17/778,960

(22) PCT Filed: Nov. 4, 2020

(86) PCT No.: PCT/IB2020/060338

§ 371 (c)(1),
(2) Date: May 23, 2022

(87) PCT Pub. No.: WO2021/105798

PCT Pub. Date: Jun. 3, 2021

(65) Prior Publication Data

US 2022/0412101 A1 Dec. 29, 2022

(30) Foreign Application Priority Data

Nov. 25, 2019 (BE) ..... 2019/5834

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0161* (2013.01); *E04F 2201/025* (2013.01)

(58) Field of Classification Search
CPC ..... E04F 15/02038; E04F 15/105; E04F 2201/0161; E04F 2201/025; E04F 15/02033; E04F 2201/0153
See application file for complete search history.

(56) References Cited

U.S. PATENT DOCUMENTS

| | | | | |
|---|---|---|---|---|
| 6,647,690 | B1 * | 11/2003 | Martensson | E04F 15/04 52/489.1 |
| 2004/0250492 | A1 | 12/2004 | Becker | |
| 2005/0123728 | A1 * | 6/2005 | Reichwein | E04F 15/04 428/192 |
| 2005/0241255 | A1 | 11/2005 | Kim | |
| 2008/0256888 | A1 * | 10/2008 | Yadong | E04F 15/02 52/506.1 |
| 2015/0218812 | A1 * | 8/2015 | Kell | E04F 15/04 428/99 |

(Continued)

FOREIGN PATENT DOCUMENTS

| | | | |
|---|---|---|---|
| CN | 102003062 | A | 4/2011 |
| DE | 19962830 | A1 | 7/2001 |

(Continued)

OTHER PUBLICATIONS

Search Report from corresponding Belgian Application No. BE201905834, Aug. 26, 2020.

(Continued)

*Primary Examiner* — Gisele D Ford
(74) *Attorney, Agent, or Firm* — Workman Nydegger

(57) ABSTRACT

A panel, which is rectangular and has long and short edges, includes a coupling part on each long edge and on each short edge, which allows coupling of the panel to another such panel.

19 Claims, 3 Drawing Sheets

(56) References Cited

U.S. PATENT DOCUMENTS

| | | | | |
|---|---|---|---|---|
| 2018/0305937 | A1* | 10/2018 | Cappelle | E04F 15/02 |
| 2019/0106887 | A1* | 4/2019 | Simon | E04F 15/08 |
| 2019/0136545 | A1* | 5/2019 | De Rick | E04F 15/105 |
| 2021/0114344 | A1* | 4/2021 | Van Vlassenrode | B32B 5/18 |
| 2022/0251854 | A1* | 8/2022 | Vermeulen | B32B 3/30 |
| 2023/0016968 | A1* | 1/2023 | Devos | E04F 15/02038 |

FOREIGN PATENT DOCUMENTS

| | | | |
|---|---|---|---|
| DE | 10038662 | A1 | 2/2002 |
| EP | 3238899 | A1 | 11/2017 |
| EP | 3567185 | A1 | 11/2019 |
| WO | 9747834 | A1 | 12/1997 |
| WO | 2019180097 | A1 | 9/2019 |

OTHER PUBLICATIONS

International Search Report from PCT Application No. PCT/IB2020/060338, Mailed May 11, 2021.

* cited by examiner

PANEL COMPRISING COUPLING PARTS

BACKGROUND

The present invention relates to a panel, for example a floor panel.

More particularly, the invention relates to a panel which is rectangular and has long and short edges. The panel comprises a coupling part on each edge which allows coupling the panel to another such panel.

Such panels are known from, for example, WO 97/47834. In this case, the coupling part on the one long edge is configured to cooperate with the coupling part on the other long edge of another such panel. The coupling part on the one short edge is configured to cooperate with the coupling part on the other short edge of another such panel. The cooperating coupling parts form a locking tongue and groove connection, both on the long and on the short edges. This is a tongue and groove connection which not only produces a vertical, but also a horizontal interlocking between the coupled edges. The vertical interlocking is brought about by the cooperation between the tongue and the groove. The horizontal interlocking is achieved by the fact that a locking lip engages in a downwardly directed locking groove.

DE19962830A1 shows a panel which has coupling parts on a first pair of opposite edges. The coupling parts on the first edge of this first pair of opposite edges are formed by a groove and a tongue. The coupling parts on the second edge of this first pair of opposite edges are formed by a tongue and a groove. During coupling of the panel, the tongue of the first edge engages in the groove of the second edge of another such panel; and the tongue of the second edge of the other such panel engages in the groove of the first edge of the panel. DE19962830A1 also provides locking elements for interlocking the coupled edges in a horizontal direction.

DE10038662A1 shows a panel which has coupling parts on a first pair of opposite edges. The coupling parts on the first edge of this first pair of opposite edges are formed by two grooves situated one above the other. The coupling parts on the second edge of this first pair of opposite edges are formed by two tongues situated one above the other. During coupling, the tongues of the second edge of the panel engage in the grooves of the first edge of another such panel. DE10038662A1 also provides locking elements for interlocking the coupled edges in a horizontal direction.

WO2019/180097 shows a panel which has a first pair of opposite edges, both provided with coupling parts which allow coupling of the panel to another such panel. The coupling part on the first edge of the first pair of opposite edges has a first tongue which has a downwardly directed locking groove and an undercut above the first tongue. The coupling part on the second edge of the first pair of opposite edges contains a groove, a locking lip with an upwardly directed locking element and a second tongue. During coupling of the first edge of the panel to the second edge of another such panel, the first tongue engages in the groove, the locking element engages over the locking lip and the second tongue in the undercut. This achieves both a horizontal and a vertical interlocking.

SUMMARY

It is the object of the invention to provide panels which can be coupled to each other in a simple manner, using little force and having better interlocking—also taking into account manufacturing tolerances.

To this end, the invention has three independent aspects which each describe panels which fulfill this object. The advantages of the panels according to the invention are particularly noticeable with panels having a thickness of less than 6 mm.

To this end, the invention, according to its first independent aspect, relates to a panel which is rectangular and has a first pair of opposite edges and a second pair of opposite edges. The panel has a top surface. On each edge of the first pair of opposite edges and on each edge of the second pair of opposite edges, the panel comprises a coupling part which allows coupling of the panel to another such panel. The coupling part on the first edge of the first pair of opposite edges has a tongue and a downwardly directed locking groove. The coupling part on the second edge of the first pair of opposite edges comprises a groove and a locking lip. The locking lip delimits the respective groove along the bottom. The locking lip comprises an upwardly directed locking element. The tongue is configured to cooperate with the groove on the second edge of the first pair of opposite edges of another such panel in order to achieve a vertical interlocking between the respective edges. The downwardly directed locking groove is configured to cooperate with the upwardly directed locking element on the second edge of the first pair of opposite edges of another such panel in order to achieve a horizontal interlocking between the respective edges.

The panel has the feature that the upwardly directed locking element of the locking lip has two oblique locking surfaces which are separated by a face which makes a smaller angle with the top surface of the panel than the two oblique locking surfaces. The downwardly directed locking groove has two oblique locking surfaces separated by a face which makes a smaller angle with the top surface of the panel than the two oblique locking surfaces. The oblique locking surfaces of the downwardly directed locking groove are configured to form an interlocking in a horizontal direction, together with the oblique locking surfaces of the upwardly directed locking element of the locking lip of another such panel.

Panels according to the first aspect of the invention have the advantage that they can be coupled to each other easily, that is to say using less force, by means of rotating or by means of pushing two profiled sections on the first pair of opposite edges substantially horizontally into one another, wherein an efficient interlocking of the edges is achieved in both a horizontal and a vertical direction.

In this text, horizontal direction is understood to mean the direction parallel to the top surface of the panel. The vertical direction is understood to mean the direction at right angles to the top surface of the panel.

Preferably, the face of the locking lip which makes a smaller angle with the top surface of the panel than the two oblique locking surfaces of the locking lip runs parallel to the top surface of the panel.

Preferably, the face of the downwardly directed locking groove which makes a smaller angle with the top surface of the panel than the two oblique locking surfaces of the downwardly directed locking groove runs parallel to the top surface of the panel.

Preferably, in the coupled position of two such panels, the face of the locking lip which makes a smaller angle with the top surface of the panel than the two oblique locking surfaces of the locking lip makes contact with the face of the downwardly directed locking groove which makes a smaller angle with the top surface of the panel than the two oblique locking surfaces of the downwardly directed locking groove.

Preferably, the surface of the face of the locking lip which makes a smaller angle with the top surface of the panel than the two oblique locking surfaces of the locking lip is greater than the surface of each of the two oblique locking surfaces of the locking lip.

Preferably, the surface of the face of the downwardly directed locking groove which makes a smaller angle with the top surface of the panel than the two oblique locking surfaces of the downwardly directed locking groove is greater than the surface of each of the two oblique locking surfaces of the downwardly directed locking groove.

Preferably, the surface of the face of the locking lip which makes a smaller angle with the top surface of the panel than the two oblique locking surfaces of the locking lip is greater than the sum of the surfaces of the two oblique locking surfaces of the locking lip.

Preferably, the surface of the face of the downwardly directed locking groove which makes a smaller angle with the top surface of the panel than the two oblique locking surfaces of the downwardly directed locking groove is greater than the sum of the surfaces of the two oblique locking surfaces of the downwardly directed locking groove.

Preferably, the surface of the oblique locking surface of the locking lip positioned closest to the top surface of the panel is smaller than the surface of the oblique locking surface of the locking lip which is furthest from the top surface of the panel.

Preferably, the surface of the oblique locking surface of the downwardly directed locking groove positioned closest to the top surface of the panel is smaller than the surface of the oblique locking surface of the downwardly directed locking groove which is furthest from the top surface of the panel.

Preferably, the angles of each of the two oblique locking surfaces of the locking lip with the face at right angles to the panel and parallel to the edge of the panel are equal.

Preferably, the angles of each of the two oblique locking surfaces of the downwardly directed locking groove with the face at right angles to the panel and parallel to the edge of the panel are equal.

Preferably, the angles of one or more—preferably of all—oblique locking surfaces of the locking lip and/or of the downwardly directed locking groove with the face at right angles to the panel and parallel to the edge of the panel are smaller than 30°, for example 20°.

In preferred embodiments of the invention, the first edge of the first pair of opposite edges has a first substantially vertical contact face; and the second edge of the first pair of opposite edges has a second substantially vertical contact face. In the coupled position of the first edge of the first pair of opposite edges of the panel and the second edge of the first pair of opposite edges of another such panel, the first substantially vertical contact face of the panel makes contact with the second substantially vertical contact face of the other such panel. The tongue extends further away from the first edge of the panel than the position of the first substantially vertical contact face.

Preferably, the first edge of the first pair of opposite edges has a first substantially vertical contact face; and the second edge of the first pair of opposite edges has a second substantially vertical contact face. In the coupled position of the first edge of the first pair of opposite edges of the panel and the second edge of the first pair of opposite edges of another such panel, the first substantially vertical contact face of the panel makes contact with the second substantially vertical contact face of the other such panel. The groove extends further inwards into the panel than the position of the second substantially vertical contact face.

Preferably, in the coupled position of two such panels, the oblique locking surfaces of the locking lip press against the oblique locking surfaces of the downwardly directed locking groove as a result of a bending stress in the locking lip.

According to a second independent aspect, optionally combined with any desired embodiment of the panel according to the first independent aspect of the invention, the invention relates to a panel which is rectangular and has a first pair of opposite edges and a second pair of opposite edges. The panel has a top surface. On each edge of the first pair of opposite edges and on each edge of the second pair of opposite edges, the panel comprises a coupling part which allows coupling of the panel to another such panel. The coupling part on the first edge of the first pair of opposite edges has a tongue and a downwardly directed locking groove. The coupling part on the second edge of the first pair of opposite edges comprises a groove and a locking lip. The locking lip delimits the respective groove along the bottom. The locking lip comprises an upwardly directed locking element. The tongue is configured to cooperate with the groove on the second edge of the first pair of opposite edges of another such panel in order to achieve a vertical interlocking between the respective edges. The downwardly directed locking groove is configured to cooperate with the upwardly directed locking element on the second edge of the first pair of opposite edges of another such panel in order to achieve a horizontal interlocking between the respective edges.

The panel is characterized by the fact that the first edge of the first pair of opposite edges has a first substantially vertical contact face. The second edge of the first pair of opposite edges has a second substantially vertical contact face. In the coupled position of the first edge of the first pair of opposite edges of the panel and the second edge of the first pair of opposite edges of another such panel, the first substantially vertical contact face of the panel makes contact with the second substantially vertical contact face of the other such panel. The coupling part of the second edge has a nose situated under the second substantially vertical contact face. The nose projects further from the second edge than the second substantially vertical contact face. The coupling part of the first edge has an undercut under the first substantially vertical contact face. The nose is configured to cooperate with the undercut on the first edge of another such panel in order to achieve a vertical interlocking between the respective edges.

Preferably, the underside of the undercut is at least partly and preferably completely defined by at least a part of the top side of the tongue.

Preferably, the nose is configured to cooperate with the undercut and the tongue of the first edge of the first pair of opposite edges of another such panel in order to achieve a vertical interlocking between the respective edges.

Preferably, in the coupled position of the first edge of the panel with the second edge of another such panel, the top side of the nose of the other such panel makes contact with the underside of the undercut of the first edge of the panel; and the underside of the nose of the other such panel makes contact with the top side of the tongue of the first edge of the panel. This results in a vertical interlocking of the two coupled edges.

Preferably, the absolute value of the angle with the top surface of the panel of the top part of the nose is greater than the angle with the top surface of the panel of the bottom part of the nose Preferably, the top side of the nose makes a positive angle with the top surface of the panel, more preferably, this positive angle is between 30° and 60° and is, for example, 45°.

Preferably, the underside of the nose makes a negative angle with the top surface of the panel, more preferably, the absolute value of this negative angle is between 0° and 15° and is, for example, 5°.

Preferably, the top side of the undercut makes a positive angle with the top surface of the panel, more preferably, this positive angle is between 30° and 60° and is, for example, 45°.

Preferably, the nose is situated above the groove.

Preferably, the nose has a rounded top.

Preferably, in the coupled position of the first edge and the second edge of such a panel, there is an open space in a horizontal direction, between the most distal part of the nose and the undercut. Such an embodiment makes it possible to compensate for manufacturing tolerances efficiently, as a result of which panels can be coupled more reliably and using less force.

Preferably, the locking lip extends further from the second edge of the panel than the nose.

According to a third independent aspect, optionally combined with any desired embodiment of the panel according to the first and/or of the second independent aspect of the invention, the invention relates to a panel which is rectangular and has a first pair of opposite edges and a second pair of opposite edges. The panel has a top surface. On each edge of the first pair of opposite edges and on each edge of the second pair of opposite edges, the panel comprises a coupling part which allows coupling of the panel to another such panel. The coupling part on the first edge of the first pair of opposite edges has a tongue and a downwardly directed locking groove. The coupling part on the second edge of the first pair of opposite edges comprises a groove and a locking lip. The locking lip delimits the respective groove along the bottom. The locking lip comprises an upwardly directed locking element. The tongue is configured to cooperate with the groove on the second edge of the first pair of opposite edges of another such panel in order to achieve a vertical interlocking between the respective edges. The downwardly directed locking groove is configured to cooperate with the upwardly directed locking element on the second edge of the first pair of opposite edges of another such panel in order to achieve a horizontal interlocking between the respective edges.

The panel is characterized by the fact that, in the coupled position of the first edge of the panel and the second edge of another such panel, the contact face with the groove on the underside of the tongue projects further from the first edge than the contact face with the groove on the top side of the tongue.

In order to determine the relative positions of these contact faces with respect to each other, the center of these contact faces with respect to each other is preferably considered.

The embodiments and features which follow may be combined with each of the first, second and third independent aspects of the invention, or with combinations of the first, second or third independent aspect of the invention.

Preferably, the panel is configured such that its first edge can be coupled to the the second edge of another such panel by means of rotation.

Preferably, the panel is configured such that it can be coupled, by means of its first edge, to the second edge of another such panel via a substantially horizontal translational movement.

Preferably, the coupling part of the first edge and/or the coupling part of the second edge is formed in one piece with and from the same material as the actual panel.

Preferably, the panel has a total thickness of less than 6 mm.

The panel is preferably a decorative panel. A decorative panel has a decor on its side which is visible in the installed position. The decor may be any desired decor, such as a wood or stone decor.

The panel preferably comprises a substrate and a top layer which is attached to the substrate. Attaching the top layer to the substrate may be effected according to any desired laminating or attachment technique. The top layer may be attached to the substrate by means of thermal lamination. The top layer may, for example, be fused with the substrate. The top layer may be attached to the substrate by means of pressure and/or heat. The top layer may be attached to the substrate by means of a bonding agent, such as glue or the like.

The top layer is preferably decorative. This means that the top layer has a decor on its side which faces away from the substrate. The decor may be any desired decor, such as a wood or stone decor.

The top layer may comprise a wooden layer. The wooden layer may be, for example, a wood veneer layer. The wooden layer may be finished with a coat of lacquer or varnish.

The top layer may comprise a printed decor; and a wear layer for protecting the printed decor.

The printed decor may be provided on a carrier. The carrier may comprise a paper sheet. The paper sheet may be impregnated with a resin. The resin is, for example, melamine resin. The carrier may comprise a plastic sheet or film. The plastic sheet or film may comprise a thermoplastic. The thermoplastic may comprise vinyl, such as for example polyvinyl chloride or PVC. The wear layer may comprise a paper sheet. The paper sheet may be impregnated with a resin. The resin is, for example, melamine resin. The wear layer may comprise hard or wear-resistant particles, such as corundum particles. The wear layer may comprise a plastic sheet or film. The plastic sheet or film may comprise a thermoplastic. The thermoplastic may comprise vinyl, such as for example polyvinyl chloride or PVC. The wear layer may comprise a lacquer layer. The lacquer layer may comprise urethane or a UV-based lacquer.

The top layer may comprise a printed decor which is applied directly onto the substrate. This is referred to as a "direct print". In this case, the decor is not first printed onto a carrier before being applied to the substrate. It is not ruled out that the directly printed decor is applied to a primer or undercoat which is present on the substrate. The directly printed decor is preferably a directly digitally printed decor and can thus be applied by means of a digital printer, such as an inkjet printer, single-pass or multi-pass.

The substrate may comprise wood. The substrate may comprise, for example, several wooden slats which are connected to each other. This is typically the case with "engineered wood". However, the substrate may also be made from wood in a single part, for example from solid wood.

The substrate may comprise wood particles and a binder for joining the wood particles together. The wood particles may be wood fibers and/or wood chips. The binder may be a glue or resin, such as for example a melamine, formaldehyde or isocyanate resin. The substrate comprises, for example, a fiberboard, such as Medium Density Fiberboard (MDF) or High Density Fiberboard (HDF), or a chipboard.

The substrate may comprise a thermoplastic material. The thermoplastic material comprises a thermoplastic. The thermoplastic may be polyvinyl chloride (PVC), polyethylene (PE), polypropylene (PP), polyurethane (PU) or polyethylene terephthalate (PET). The thermoplastic material may comprise polyvinyl chloride with or without plasticizers. The thermoplastic material may comprise polyvinyl chloride with an amount of plasticizer of at most 5 phr. The thermoplastic material may comprise polyvinyl chloride with an amount of plasticizer of at least 12 phr or at least 20 phr. In this case, phr stands for "parts per hundred resin". The thermoplastic material may optionally be foamed. The thermoplastic material may comprise closed-cell or open-cell foam. The thermoplastic material may comprise a filler. The filler may be an organic filler, such as wood particles. The filler may be an inorganic filler. The filler may be a mineral filler, such as calcium carbonate, for example chalk or limestone. The filler may be talc.

The substrate may comprise a thermosetting material. The thermosetting material comprises a thermosetting plastic. The thermosetting plastic may be polyurethane (PU). The thermosetting material may comprise a filler. The filler may be an organic filler, such as wood particles. The filler may be an inorganic filler. The filler may be a mineral filler, such as calcium carbonate, for example chalk or limestone. The filler may be talc.

The substrate may comprise any desired other material, such as a cement fiber board or a magnesium board.

The panel may be made as a single part. The panel may, for example, be made from wood as a single part. This is the case, for example, with solid parquet.

The panel may be a floor, wall or ceiling panel. A different type of panel is not ruled out.

BRIEF DESCRIPTION OF THE DRAWINGS

With a view to giving a more detailed description of the features of the invention, several preferred embodiments are described below by way of non-limiting example with reference to the attached drawings, in which.

DETAILED DESCRIPTION OF VARIOUS EMBODIMENTS

Figure 1:
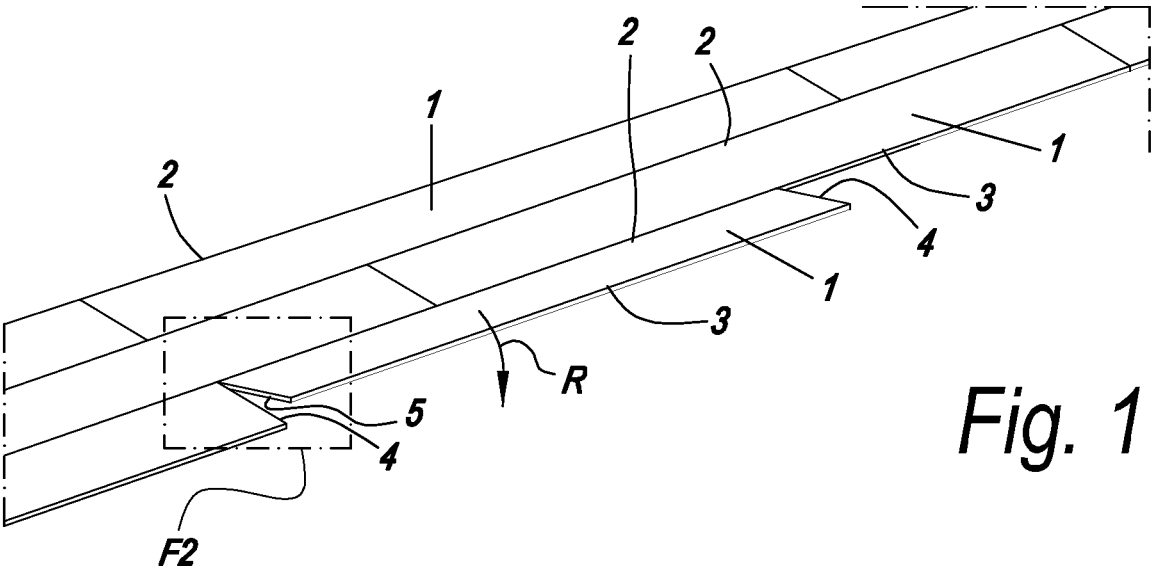
FIG. 1 diagrammatically and in perspective shows a floor covering, wherein the floor covering consists of floor panels according to the invention.
Figure 2:
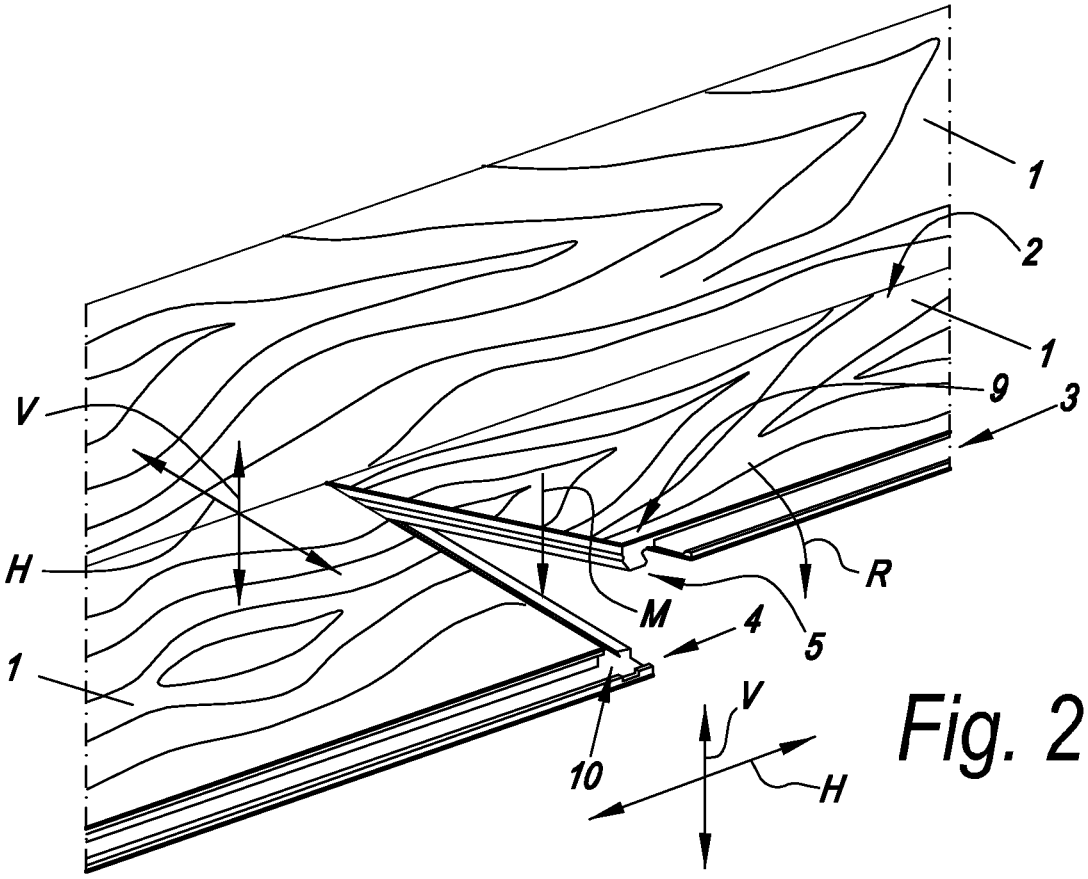
FIG. 2 shows the component from FIG. 1 denoted as F2 on an enlarged scale.
Figure 3:
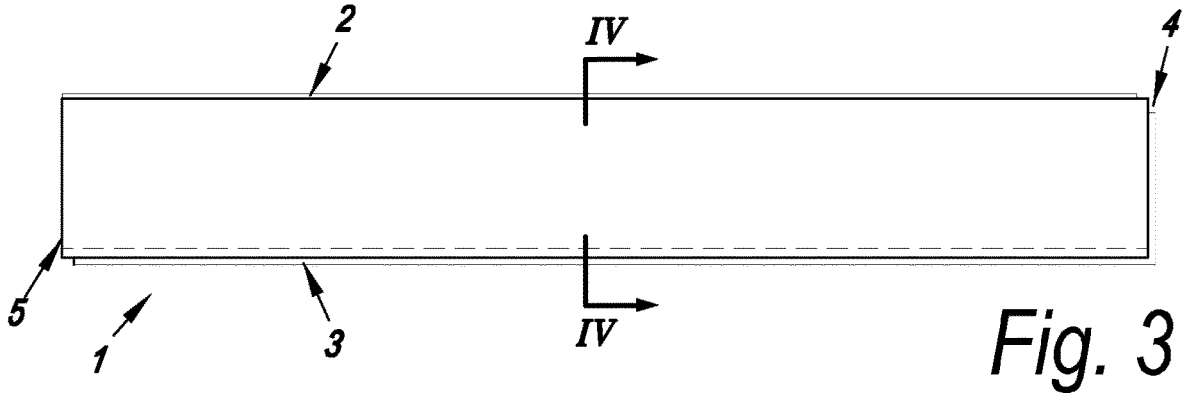
FIG. 3 shows a top view of a floor panel of the floor covering from FIGS. 1 and 2.
Figure 4:
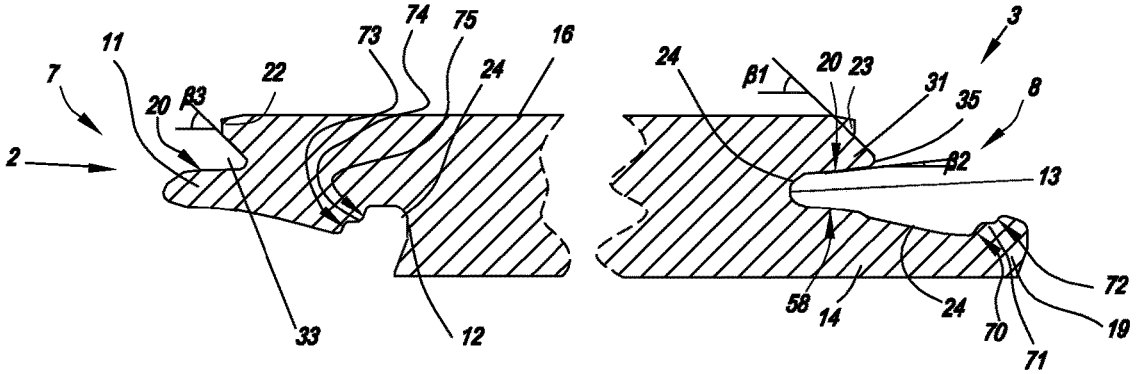
FIG. 4 shows a cross section along line Iv-Iv in FIG. 3.
Figure 7:
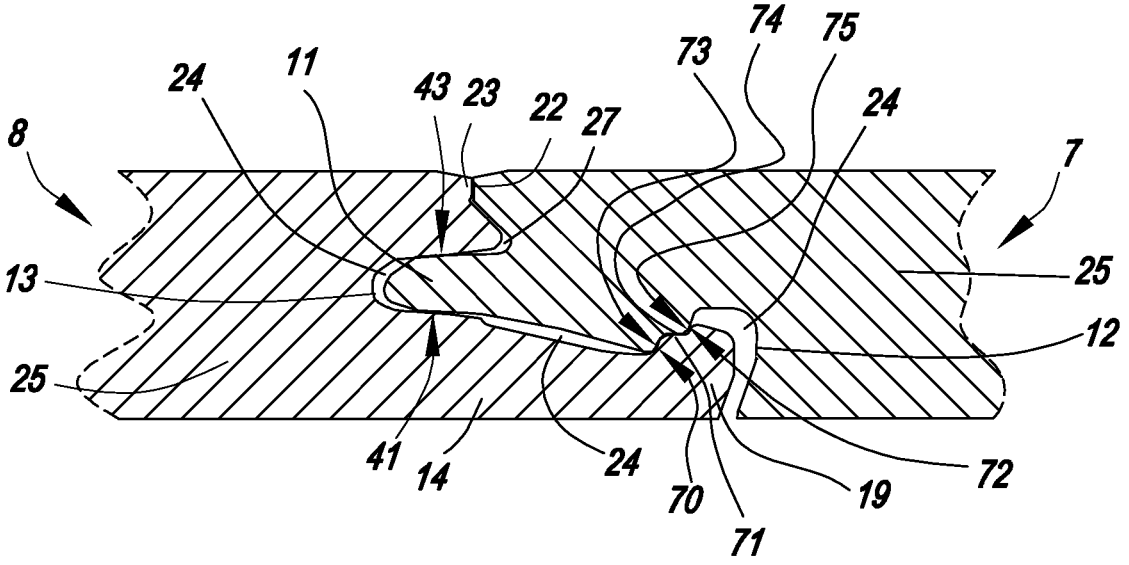
FIG. 7 shows a cross section of two panels of the floor covering from FIG. 1 coupled along their long edges.

As is illustrated in FIGS. 1 and 2, the invention relates to rectangular decorative floor panels (1) for forming a floor covering, which floor panels (1) have a first pair of opposite edges (2-3) and a second pair of opposite edges (4-5). The floor panels have a thickness of, for example, 5 mm. FIG. 3 shows a top view of a floor panel of the floor covering from FIGS. 1 and 2. FIG. 4 shows a cross section along line IV-IV in FIG. 3. FIG. 7 shows a cross section of two panels of the floor covering from FIG. 1 coupled along their long edges.

The edges of the illustrated floor panels (1) from the example are configured in such a way that they are couplable to each other according to the so-called fold-down principle, which is a principle which is well-known per se and which makes it possible to couple such floor panels (1) to each other on the first pair of edges (2-3) via a rotating movement R and on the second pair of edges (4-5) via a downward movement M, wherein the downward movement M is the result of the rotating movement R and thus takes place substantially at the same time. In this case, the edges (2-3) and (4-5) of the floor panels 1 are also configured in such a way that eventually an interlocking in a vertical direction V and in a horizontal direction H, the latter at right angles to the respective edges, is effected.

As is illustrated in the figures, such a floor panel 1 is to this end provided with coupling parts (7-8) on its first pair of edges (2-3), whereas coupling parts (9-10) are also provided on the second pair of edges. These coupling parts (7-8, 9-10) are made in one piece with and from the same material as the actual panel (1). The coupling parts of the first pair of edges are described in more detail below with reference to FIGS. 4 to 7.

The panels have a top surface (16). The coupling part (7) on the first edge (2) of the first pair of opposite edges has a tongue (11) and a downwardly directed locking groove (12). The coupling part (8) on the second edge (3) of the first pair of opposite edges comprises a groove (13) and a locking lip (14). The locking lip (14) delimits the respective groove (13) along the bottom; the locking lip (14) comprises an upwardly directed locking element (19). The tongue (11) is configured to cooperate with the groove (13) on the second edge (3) of the first pair of opposite edges of another such panel (1) in order to achieve a vertical interlocking between the respective edges (2-3). The downwardly directed locking groove (12) is configured to cooperate with the upwardly directed locking element (19) on the second edge (3) of the first pair of opposite edges of another such panel (1) in order to achieve a horizontal interlocking between the respective edges. The upwardly directed locking element (19) of the locking lip (14) has two oblique locking surfaces (70, 72) separated by a face (71) which makes a smaller angle with the top surface (16) of the panel than the two oblique locking surfaces (70, 72).

The face (71) of the locking lip (14) which makes a smaller angle with the top surface (16) of the panel than the two oblique locking surfaces (70, 72) of the locking lip (14) runs parallel to the top surface (16) of the panel. The surface of the face (71) of the locking lip (14) which makes a smaller angle with the top surface (16) of the panel than the two oblique locking surfaces (70, 72) of the locking lip (14) is greater than the sum of the surfaces of the two oblique locking surfaces (70, 72) of the locking lip (14). The surface of the oblique locking surface (72) of the locking lip (14) positioned closest to the top surface (16) of the panel (1) is smaller than the surface of the oblique locking surface (70) of the locking lip (14) which is furthest from the top surface (16) of the panel.

The angles ($\alpha$1, $\alpha$2) of each of the two oblique locking surfaces (70, 72) of the locking lip (14) with the face at right angles to the panel and parallel to the edge of the panel are equal.

The downwardly directed locking groove (12) has two oblique locking surfaces (73, 75) separated by a face (74) which makes a smaller angle with the top surface (16) of the panel than the two oblique locking surfaces (73, 75). The face (74) of the downwardly directed locking groove (12) which makes a smaller angle with the top surface (16) of the panel than the two oblique locking surfaces (73, 75) of the downwardly directed locking groove (12) runs parallel to the top surface (16) of the panel. The surface of the face (74) of the downwardly directed locking groove (12) which makes a smaller angle with the top surface (16) of the panel than the two oblique locking surfaces (73, 75) of the downwardly directed locking groove (12) is greater than the sum of the surfaces of the two oblique locking surfaces (73, 75) of the downwardly directed locking groove (12). The surface of the oblique locking surface (75) of the downwardly directed locking groove (12) positioned closest to the top surface (16) of the panel (1) is smaller than the surface of the oblique locking surface (73) of the downwardly directed locking groove (12) which is furthest from the top surface of the panel. The angles (a3, a4) of each of the two oblique locking surfaces (73, 75) of the downwardly directed locking groove (12) with the face at right angles to the panel and parallel to the edge of the panel are equal. In the example. the angles ($\alpha$1, $\alpha$2, $\alpha$3, $\alpha$4) of the four oblique locking surfaces (70, 72, 73, 75) with the face at right angles to the panel and parallel to the edge of the panel are all 20°.

The oblique locking surfaces (73, 75) of the downwardly directed locking groove (12) are configured to form an interlocking in a horizontal direction together with the oblique locking surfaces (70, 72) of the upwardly directed locking element (19) of the locking lip (14) of another such panel. In the coupled position of two such panels, the face (71) of the locking lip (14) which makes a smaller angle with the top surface (16) of the panel than the two oblique locking surfaces (70, 72) of the locking lip (14) makes contact with the face (74) of the downwardly directed locking groove (12) which makes a smaller angle with the top surface (16) of the panel than the two oblique locking surfaces (73, 75) of the downwardly directed locking groove (12).

The first edge (2) of the first pair of opposite edges has a first substantially vertical contact face (22) and the second edge (3) of the first pair of opposite edges has a second substantially vertical contact face (23). In the coupled position of the first edge (2) of the first pair of opposite edges of the panel and the second edge (3) of the first pair of opposite edges of another such panel, the first substantially vertical contact face (22) of the panel (1) makes contact with the second substantially vertical contact face (23) of the other such panel. The tongue (11) extends further away from the first edge (2) of the panel than the position of the first substantially vertical contact face (22). The groove (13) extends further inwards into the panel than the position of the second substantially vertical contact face (23).

Figure 5:
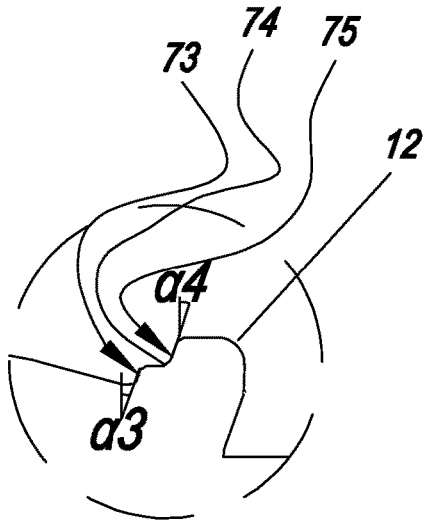
FIGS. 5 and 6 show details of the cross section of the coupling parts.
Figure 6:
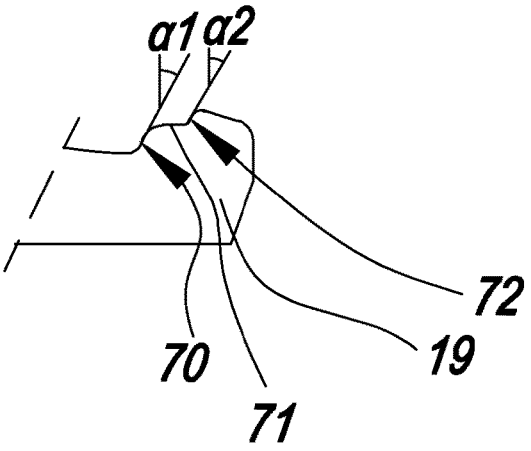

FIG. 5 shows a detail of the downwardly directed locking groove 12. FIG. 6 shows a detail of the upwardly directed locking element.

In the coupled position, the oblique locking surfaces (70, 72) of the locking lip (14) press against the oblique locking surfaces (73, 75) of the downwardly directed locking groove (12) as a result of a bending stress in the locking lip.

The coupling part (8) of the second edge (3) has a nose (31) situated under the second substantially vertical contact face (23). The nose (31) projects further from the second edge (3) than the second substantially vertical contact face (23). The nose (31) is situated above the groove (13) and has a rounded top (35). The locking lip (14) extends further from the second edge (3) of the panel than the nose (31). The coupling part (7) of the first edge (2) has an undercut (33) under the first substantially vertical contact face (22). The underside of the undercut (33) is defined by the top side of the tongue.

The nose (31) is configured to cooperate with the undercut (33) and the tongue (11) of the first edge (2) of the first pair of opposite edges of another such panel (1) in order to achieve a vertical interlocking between the respective edges (2-3).

In the coupled position of the first edge (2) of the panel (1) and the second edge (3) of another such panel, the top side of the nose (31) of the other such panel makes contact with the underside of the undercut (33) of the first edge (2) of the panel; and the underside of the nose (31) of the other such panel makes contact with the top side of the tongue (11) of the first edge (2) of the panel, resulting in a vertical interlocking of the two coupled edges (2-3).

The top side of the nose (31) makes a positive angle ($\beta$1) with the top surface (16) of the panel, in the example this angle is 45°. The underside of the nose (31) makes a negative angle ($\beta$2) with the top surface (16) of the panel, this angle having an absolute value of 5° in the example.

The top side of the undercut (33) makes a positive angle ($\beta$3) with the top surface (16) of the panel, in the example this angle ($\beta$3) is 45°.

In the coupled position of the first edge and the second edge of such a panel, there is an open space (27) between the most distal part of the nose (31) and the undercut (33) in a horizontal direction.

Furthermore, one or more spaces or air gaps (24) are formed between the coupled edges (2-3) of the panels (1).

In the coupled position of the first edge (2) of the panel and the second edge (3) of another such panel, the contact face (41) with the groove (13) on the underside of the tongue (11) projects further from the first edge (2) than the contact face (43) with the groove (13) on the top side of the tongue (11).

The panels described in the example may be coupled with their first edge (2) onto the second edge (3) of another such panel by means of rotation; but it is also possible to couple the panel (1) with its first edge (2) onto the second edge (3) of another such panel by means of a substantially horizontal translational movement.

The present invention is by no means limited to the above-described embodiments, but such panels can be realised according to different variants without departing from the scope of the present invention.

The invention claimed is:

1. A panel which is rectangular and has a first pair of opposite edges and a second pair of opposite edges, wherein the panel has a top surface, wherein, on first and second edges of the first pair of opposite edges and first and second edges of the second pair of opposite edges, the panel comprises a coupling part which allows coupling of the panel to another such panel;

the coupling part on the first edge of the first pair of opposite edges has a tongue and a downwardly directed locking groove;

the coupling part on the second edge of the first pair of opposite edges comprises a groove and a locking lip;

wherein the locking lip delimits the groove along a bottom and wherein the locking lip comprises an upwardly directed locking element;

wherein the tongue is configured to cooperate with the groove on the second edge of the first pair of opposite edges of another such panel in order to achieve a vertical interlocking between the respective edges; and wherein the downwardly directed locking groove is configured to cooperate with the upwardly directed locking element on the second edge of the first pair of opposite edges of another such panel in order to achieve a horizontal interlocking between the respective edges;

wherein the upwardly directed locking element of the locking lip has two oblique locking surfaces separated by a face which makes a smaller angle with the top surface of the panel than the two oblique locking surfaces;

in that the downwardly directed locking groove has two oblique locking surfaces separated by a face which makes a smaller angle with the top surface of the panel than the two oblique locking surfaces; and in that the oblique locking surfaces of the downwardly directed locking groove are configured to form an interlocking in a horizontal direction together with the oblique locking surfaces of the upwardly directed locking element of the locking lip of another such panel;

wherein, in a coupled position of two such panels, the oblique locking surfaces of the locking lip press against the oblique locking surfaces of the downwardly directed locking groove as a result of a bending stress in the locking lip.

2. The panel in accordance with claim 1, wherein the face of the locking lip which makes a smaller angle with the top surface of the panel than the two oblique locking surfaces of the locking lip runs parallel to the top surface of the panel and/or wherein the face of the downwardly directed locking groove which makes a smaller angle with the top surface of the panel than the two oblique locking surfaces of the downwardly directed locking groove runs parallel to the top surface of the panel.

3. The panel in accordance with claim 1, wherein, in the coupled position of two such panels, the face of the locking lip which makes a smaller angle with the top surface of the panel than the two oblique locking surfaces of the locking lip makes contact with the face of the downwardly directed locking groove which makes a smaller angle with the top surface of the panel than the two oblique locking surfaces of the downwardly directed locking groove.

4. The panel in accordance with claim 1, wherein the surface of the face of the locking lip which makes a smaller angle with the top surface of the panel than the two oblique locking surfaces of the locking lip is greater than the surface of each of the two oblique locking surfaces of the locking lip and/or wherein the surface of the face of the downwardly directed locking groove which makes a smaller angle with the top surface of the panel than the two oblique locking surfaces of the downwardly directed locking groove is greater than the surface of each of the two oblique locking surfaces of the downwardly directed locking groove.

5. The panel in accordance with claim 1, wherein the surface of the face of the locking lip which makes a smaller angle with the top surface of the panel than the two oblique locking surfaces of the locking lip is greater than a sum of the surfaces of the two oblique locking surfaces of the locking lip and/or wherein the surface of the face of the downwardly directed locking groove which makes a smaller angle with the top surface of the panel than the two oblique locking surfaces of the downwardly directed locking groove is greater than the sum of the surfaces of the two oblique locking surfaces of the downwardly directed locking groove.

6. The panel in accordance with claim 1, wherein the surface of the oblique locking surface of the locking lip positioned closest to the top surface of the panel is smaller than the surface of the oblique locking surface of the locking lip which is furthest from the top surface of the panel and/or wherein the surface of the oblique locking surface of the downwardly directed locking groove positioned closest to the top surface of the panel is smaller than the surface of the oblique locking surface of the downwardly directed locking groove which is furthest from the top surface of the panel.

7. The panel in accordance with claim 1, wherein the angles of each of the two oblique locking surfaces of the locking lip with a face at right angles to the panel and parallel to the edge of the panel are equal and/or wherein the angles of each of the two oblique locking surfaces of the downwardly directed locking groove with a face at right angles to the panel and parallel to the edge of the panel are equal.

8. The panel in accordance with claim 1, wherein the angles of one or more oblique locking surfaces of the locking lip and/or of the downwardly directed locking groove with the face at right angles to the panel and parallel to the edge of the panel is smaller than 30°.

9. The panel in accordance with claim 1, wherein the first edge of the first pair of opposite edges has a first substantially vertical contact face;

the second edge of the first pair of opposite edges has a second substantially vertical contact face;

in the coupled position of the first edge of the first pair of opposite edges of the panel and the second edge of the first pair of opposite edges of another such panel, the first substantially vertical contact face of the panel makes contact with the second substantially vertical contact face of the other such panel;

the tongue extends further away from the first edge of the panel than the position of the first substantially vertical contact face.

10. The panel in accordance with claim 1, wherein the first edge of the first pair of opposite edges contains a first substantially vertical contact face;

the second edge of the first pair of opposite edges has a second substantially vertical contact face;

in the coupled position of the first edge of the first pair of opposite edges of the panel and the second edge of the first pair of opposite edges of another such panel, the first substantially vertical contact face of the panel makes contact with the second substantially vertical contact face of the other such panel;

the groove extends further inwards into the panel than the position of the second substantially vertical contact face.

11. A panel which is rectangular and has a first pair of opposite edges and a second pair of opposite edges, wherein the panel has a top surface, wherein, on first and second edges of the first pair of opposite edges and first and second edges of the second pair of opposite edges, the panel comprises a coupling part which allows coupling of the panel to another such panel;

the coupling part on the first edge of the first pair of opposite edges has a tongue and a downwardly directed locking groove;

the coupling part on the second edge of the first pair of opposite edges comprises a groove and a locking lip;

wherein the locking lip delimits the groove along a bottom and wherein the locking lip comprises an upwardly directed locking element;

wherein the tongue is configured to cooperate with the groove on the second edge of the first pair of opposite edges of another such panel in order to achieve a vertical interlocking between the respective edges; and wherein the downwardly directed locking groove is configured to cooperate with the upwardly directed locking element on the second edge of the first pair of opposite edges of another such panel in order to achieve a horizontal interlocking between the respective edges;

wherein the first edge of the first pair of opposite edges has a first substantially vertical contact face;

the second edge of the first pair of opposite edges has a second substantially vertical contact face;

in a coupled position of the first edge of the first pair of opposite edges of the panel and the second edge of the first pair of opposite edges of another such panel, the first substantially vertical contact face of the panel makes contact with the second substantially vertical contact face of the other such panel;

the coupling part of the second edge has a nose situated under the second substantially vertical contact face, wherein the nose projects further from the second edge than the second substantially vertical contact face;

the coupling part of the first edge has an undercut under the first substantially vertical contact face;

wherein the nose is configured to cooperate with the undercut on the first edge of another such panel in order to achieve a vertical interlocking between the respective edges.

12. The panel in accordance with claim 11, wherein an underside of the undercut is at least partly and completely defined by at least a part of a top side of the tongue.

13. The panel in accordance with claim 11, wherein the nose is configured to cooperate with the undercut and the tongue of the first edge of the first pair of opposite edges of another such panel in order to achieve a vertical interlocking between the respective edges.

14. The panel in accordance with claim 11, wherein, in the coupled position of the first edge of the panel and the second edge of another such panel, a top side of the nose of the other such panel makes contact with an underside of the undercut of the first edge of the panel; and an underside of the nose of the other such panel makes contact with a top side of the tongue of the first edge of the panel, resulting in a vertical interlocking of the two coupled edges.

15. The panel in accordance with claim 11, wherein the absolute value of an angle of a top part of the nose with the top surface of the panel is greater than the angle of a bottom part of the nose with the top surface of the panel.

16. The panel in accordance with claim 11, wherein a top side of the nose makes a positive angle with the top surface of the panel, this positive angle being between 30° and 60° and/or wherein an underside of the nose makes a negative angle with the top surface of the panel, the absolute value of this negative angle being between 0° and 15° and/or wherein the top side of the undercut makes a positive angle with the top surface of the panel, this positive angle being between 30° and 60°.

17. The panel in accordance with claim 11, wherein, in the coupled position of the first edge and the second edge of a such panel, there is an open space in a horizontal direction, between a most distal part of the nose and the undercut.

18. The panel in accordance with claim 11, wherein the locking lip projects further from the second edge of the panel than the nose.

19. A panel, which is rectangular and has a first pair of opposite edges and a second pair of opposite edges, wherein the panel has a top surface, wherein, on each edge of the first pair of opposite edges and on each edge of the second pair of opposite edges, the panel comprises a coupling part which allows coupling of the panel to another such panel;

the coupling part on the first edge of the first pair of opposite edges has a tongue and a downwardly directed locking groove;

the coupling part on the second edge of the first pair of opposite edges comprises a groove and a locking lip;

wherein the locking lip delimits the respective groove along the bottom and wherein the locking lip comprises an upwardly directed locking element;

wherein the tongue is configured to cooperate with the groove on the second edge of the first pair of opposite edges of another such panel in order to achieve a vertical interlocking between the respective edges; and wherein the downwardly directed locking groove is configured to cooperate with the upwardly directed locking element on the second edge of the first pair of opposite edges of another such panel in order to achieve a horizontal interlocking between the respective edges;

wherein, in a coupled position of the first edge of the panel and the second edge of another such panel, a contact face defined by the groove on an underside of the groove and corresponding to an underside of the tongue projects further from the first edge than a contact face defined by the groove on a top side of the groove and corresponding with a top side of the tongue;

wherein the top side of the groove extends at a negative angle relative to the top surface of the panel.

* * * * *